US005429051A

United States Patent [19]

Laubscher

[11] Patent Number: 5,429,051

[45] Date of Patent: Jul. 4, 1995

[54] PRINTING-UNIT ASSEMBLY WITH SMEAR-PREVENTING DEVICE OF A WEB-FED PRINTING PRESS AND METHOD OF OPERATION

[75] Inventor: Hans-Jörg Laubscher, Frankenthal, Germany

[73] Assignee: Heidelberger Druckmaschinen AG, Heidelberg, Germany

[21] Appl. No.: 124,169

[22] Filed: Sep. 20, 1993

[30] Foreign Application Priority Data

Sep. 18, 1992 [DE] Germany ..... 42 31 263.9

[51] Int. Cl.[6] ..... B41F 35/00

[52] U.S. Cl. ..... 101/417; 101/424.1; 101/219; 101/488

[58] Field of Search ..... 101/487, 488, 417, 424.1, 101/212, 218, 219; 62/119; 34/62

[56] References Cited

U.S. PATENT DOCUMENTS

| | | | |
|---|---|---|---|
| 1,724,644 | 8/1929 | De Long | 101/424.1 |
| 1,831,624 | 11/1931 | Francoise | 101/424.1 |
| 2,147,651 | 2/1939 | Jones et al. . | |
| 2,972,302 | 2/1961 | Bernardi | 101/488 |
| 4,263,724 | 4/1981 | Vits . | |
| 4,481,790 | 11/1984 | Mattes . | |
| 4,920,881 | 1/1990 | Tafel . | |
| 5,040,462 | 8/1991 | Hillenbrand et al. . | |
| 5,092,241 | 3/1992 | Feser et al. . | |
| 5,178,064 | 1/1993 | Kerber et al. | 101/487 |
| 5,184,555 | 2/1993 | Quadracci et al. | 101/417 |
| 5,189,960 | 3/1993 | Valentini et al. | 101/487 |

FOREIGN PATENT DOCUMENTS

| | | | |
|---|---|---|---|
| 0283722 | 9/1988 | European Pat. Off. . | |
| 146916 | 3/1981 | German Dem. Rep. . | |
| 460035 | 5/1928 | Germany . | |
| 477308 | 6/1929 | Germany | 101/424.1 |
| 2127021 | 1/1972 | Germany . | |
| 2658380 | 7/1978 | Germany | 101/424.1 |
| 3838674 | 5/1990 | Germany . | |
| 3939432 | 6/1991 | Germany . | |
| 0161152 | 8/1985 | Japan | 101/487 |
| 2102344 | 2/1983 | United Kingdom | 101/488 |

*Primary Examiner*—Eugene H. Eickholt

*Attorney, Agent, or Firm*—Herbert L. Lerner; Laurence A. Greenberg

[57] ABSTRACT

Printing-unit assembly of a web-fed printing press, the printing-unit assembly having a smear-preventing device and being assembled of at least two satellite printing unit sub-assemblies, respectively, including a satellite cylinder, one of the satellite printing unit sub-assemblies being actuatable for printing on one side of web stock, and the other of the satellite printing unit sub-assemblies being actuatable for printing thereafter on the other side of the web stock, the smear-preventing device being associated with the satellite cylinder of the other satellite printing unit assembly for preventing smearing of printing ink, and includes a device for cooling an outer cylindrical surface of the satellite cylinder of the other satellite printing unit sub-assembly to a temperature below the dew point; and method of cooling.

5 Claims, 2 Drawing Sheets

Figure 1:
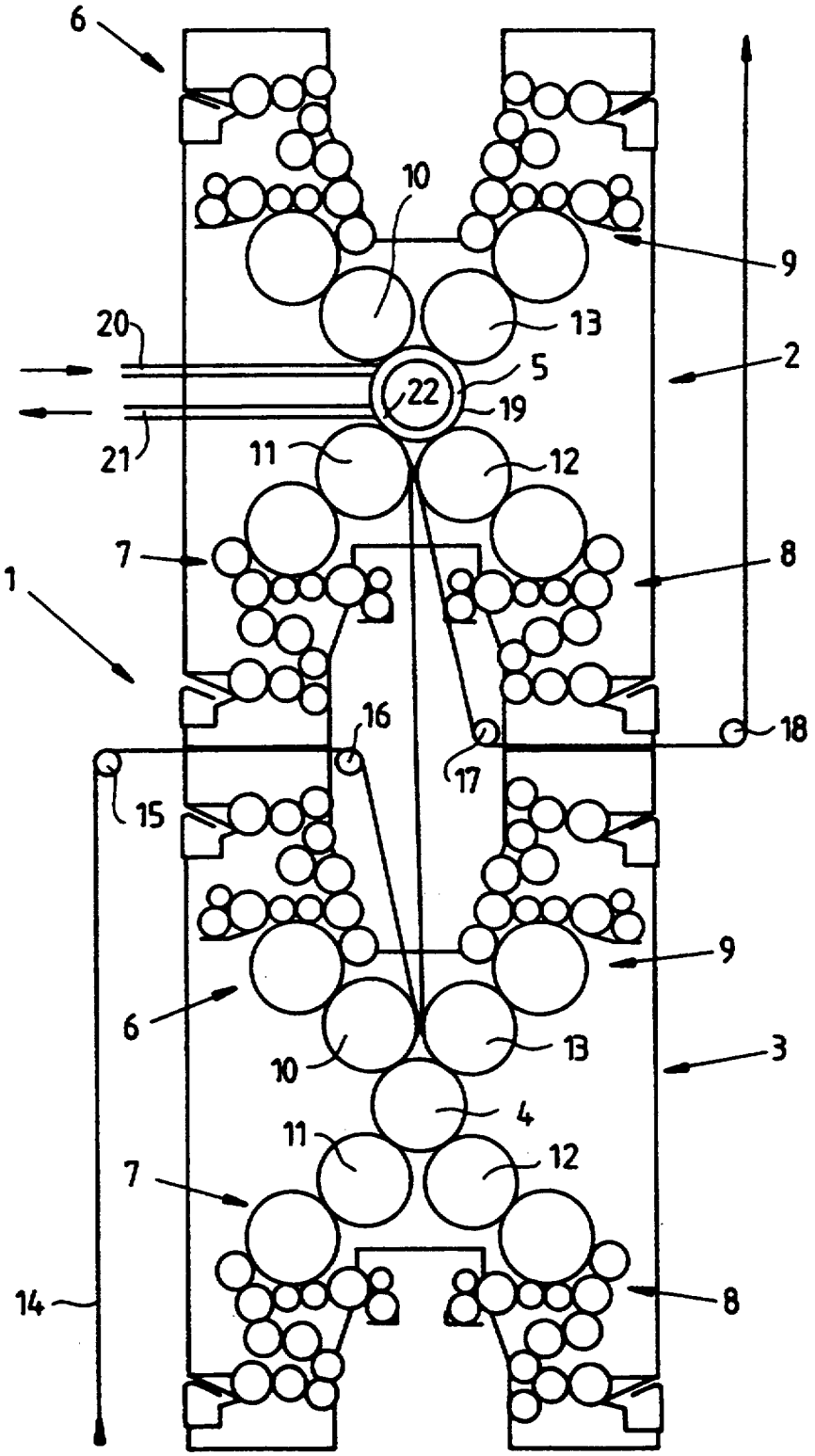

PRINTING-UNIT ASSEMBLY WITH SMEAR-PREVENTING DEVICE OF A WEB-FED PRINTING PRESS AND METHOD OF OPERATION

SPECIFICATION

The invention relates to a printing-unit assembly of a web-fed printing press, the printing-unit assembly having a device for preventing the smearing of ink, i.e., a smear-preventing device, and being assembled of at least two satellite printing unit sub-assemblies, respectively, including a satellite cylinder, one of the satellite printing unit sub-assemblies being actuatable for printing on one side of web stock, and the other of the satellite printing unit sub-assemblies being actuatable for printing thereafter on the other side of the web stock, the smear-preventing device being associated with the satellite cylinder of the other satellite printing unit sub-assembly for preventing smearing of printing ink; and a method of operating the smear-preventing device.

A device of this general type has become known heretofore from German Published Non-Prosecuted Application (DE-OS) 39 39 432, which describes a printing-unit tower with superposed satellite printing units. A stock web is fed to the lower satellite printing unit and is printed on one side thereof. Proceeding further, the stock web then passes through the upper satellite printing unit, wherein the other side thereof becomes printed on. To prevent the printing ink applied by the lower satellite printing unit from being smeared as the stock web passes over the satellite cylinder of the upper printing unit, a smear-prevention device is associated with the latter satellite cylinder. The smear-prevention device includes a spray bar which wets the outer cylindrical surface of the satellite cylinder of the upper printing unit, thereby preventing fresh ink from smearing thereon. Alternatively, instead of the smear-prevention device, it is possible to install a cleaning device which permanently cleans the surface of the satellite cylinder of the upper printing unit during the printing process, so that printing ink which is transferred to the surface is removed.

A disadvantage of these heretofore known devices is that the association of the smear-prevention device and cleaning device, respectively, with the satellite cylinder of the second satellite printing cylinder unit requires a by-no-means inconsiderable amount of space, which is available only to a very limited extent in the case of satellite printing units. Furthermore, the heretofore known smear-prevention device referred to hereinbefore has a relatively elaborate construction.

It is accordingly an object of the invention, therefore, to provide a printing-unit assembly of the type initially mentioned herein, which requires little or no additional space and is of very simple construction.

With the foregoing and other objects in view, there is provided, in accordance with the invention, a printing-unit assembly of a web-fed printing press, the printing-unit assembly having a smear-preventing device and being assembled of at least two satellite printing unit sub-assemblies, respectively, including a satellite cylinder, one of the satellite printing unit sub-assemblies being actuatable for printing on one side of web stock, and the other of the satellite printing unit sub-assemblies being actuatable for printing thereafter on the other side of the web stock, the smear-preventing device being associated with the satellite cylinder of the other satellite printing unit assembly for preventing smearing of printing ink, the smear-preventing device comprising means for cooling an outer cylindrical surface of the satellite cylinder of the other satellite printing unit sub-assembly to a temperature below the dew point.

Moisture is thereby deposited on the outer cylindrical surface, which behaves like non-printing areas of an offset printing plate and rejects the ink. Consequently, according to the invention, printing ink is prevented from being smeared on the outer cylindrical surface; that is, printing ink does not at all get onto the outer cylindrical surface in the first place. A cleaning device of the aforementioned type heretofore known in the prior art is not therefore required. Due to the relatively high humidity in the satellite printing units, especially in 4-color units, cooling to a temperature below the dew point is attained already at temperatures which are not particularly low. Consequently, only a relatively low cooling capacity is required. Because the cooling device according to the invention does not need to be disposed in the direct vicinity of the satellite cylinder of the other satellite printing unit sub-assembly, but merely requires a line for routing the coolant to that satellite cylinder, virtually no space is needed in the immediate vicinity of the printing unit sub-assembly for the smear-preventing device, because the smear-preventing device acts, as it were, "from inside"; that is, according to the invention, the satellite cylinder itself, because of its cooling, has the attributes of the smear-preventing device. Conversely, in the prior art, the smear-preventing device acts from outside and must be installed with a suitable space requirement, in the direct vicinity of the satellite cylinder.

In accordance with another feature of the invention, the cooling means include at least one coolant channel formed in the satellite cylinder of the other satellite printing unit sub-assembly, the coolant channel being traversible by a coolant of the cooling means.

In accordance with a further feature of the invention, the one coolant channel extends helically below the outer cylindrical surface of the satellite cylinder of the other satellite printing unit sub-assembly. High flow rates and high heat-transfer coefficients are thus able to be attained thereby.

In accordance with an added feature of the invention, the outer cylindrical surface of the satellite cylinder of the other satellite printing unit sub-assembly is made of metal.

In accordance with an additional feature of the invention, the metal is chromium plated on the outer cylindrical surface of the satellite cylinder of the other satellite printing unit sub-assembly. The combination of the chrome surface with cooling to a temperature below the dew point results in particularly good results in the prevention of smearing.

In accordance with a concomitant aspect of the invention, there is provided a method of preventing smearing of printing ink onto an outer cylindrical surface of a backpressure cylinder of a printing press, which comprises cooling the outer cylindrical surface to a temperature below the dew point.

Other features which are considered as characteristic for the invention are set forth in the appended claims.

Although the invention is illustrated and described herein as embodied in a printing-unit assembly with a smear-preventing device of a web-fed printing press, it is nevertheless not intended to be limited to the details shown, since various modifications and structural changes may be made therein without departing from the spirit of the invention and within the scope and range of equivalents of the claims.

Figure 2:
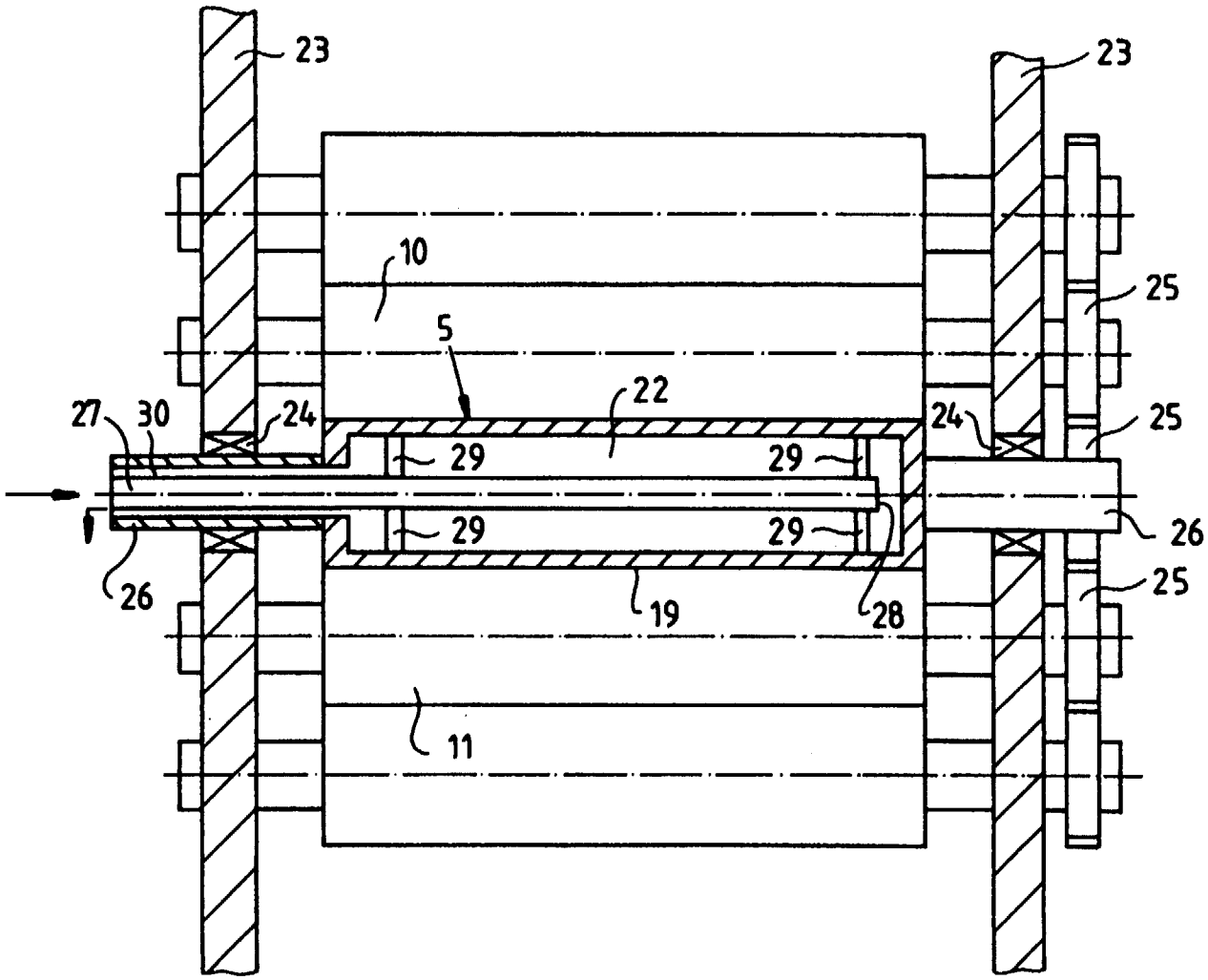

The construction and method of operation of the invention, however, together with additional objects and advantages thereof will be best understood from the following description of specific embodiments when read in connection with the accompanying drawings, in which:

FIG. 1 is a diagrammatic view of a printing-unit assembly with two satellite printing units; and FIG. 2 is a much-enlarged fragmentary sectional view of FIG. 1 showing part of the upper satellite printing unit with the smear-preventing device according to the invention.

Referring now to the drawings and, first, particularly to FIG. 1 thereof, there is shown therein a printing-unit assembly 1, which includes two satellite printing-unit sub-assemblies 2 and 3 superposed on one another. Thus, the satellite printing unit sub-assembly 3 constitutes a lower, first sub-assembly of satellite printing units, and the satellite printing-unit sub-assembly 2 constitutes an upper, second sub-assembly of satellite printing units.

Each of the satellite printing unit sub-assemblies 2 and 3, respectively, has a satellite cylinder 4 or 5, respectively, which cooperates with four printing units 6, 7, 8, 9. Each printing unit 6 to 9 is provided for a specific printing ink and includes an inking unit and a dampening unit. The individual rollers of the inking and dampening units are shown highly diagrammatically in FIG. 1, but, in the interest of simplicity, have not been provided with reference characters. Each printing unit 6 to 9 has an impression cylinder 10, 11, 12 and 13, respectively, which is able to be brought into engagement with the respective satellite cylinder 4 or 5, which serves as a back pressure cylinder.

For printing, web stock 14 is guided vertically upwards adjacent the satellite printing unit 3 and is then introduced, by means of a guide roller 15, horizontally into the region between the two satellite printing unit sub-assemblies 2 and 3. By means of a further guide roller 16, the web stock 14 is then fed to the satellite printing unit sub-assembly 3 in a manner that it passes in an almost closed loop around the satellite cylinder 4, wherefrom it extends more or less vertically upwards.

The web stock 14 is then passed in an almost closed loop around the satellite cylinder 5 of the upper satellite printing unit sub-assembly 2 and then again runs, at an inclination, downwardly as far as a guide roller 17, which guides the web stock 14, in the region between the two satellite printing unit sub-assemblies 2 and 3, to the right-hand side (FIG. 1) and to the outside, where it is deflected upwardly by means of a guide roller 18, from which it is extends to non-illustrated other devices of the printing press. Due to this guidance of the web stock 14, it is printed on from one side by means of the satellite printing unit sub-assembly 3 and then from the other side by means of the satellite printing unit sub-assembly 2.

In accordance with the invention, the satellite cylinder 5 can be cooled by means of a non-illustrated cooling device, so that the outer cylindrical surface 19 thereof acquires a temperature which is below the dew point. A film of moisture thereby forms on the outer cylindrical surface 19 which prevents smearing, on the web stock 14, of the fresh printing ink coming from the satellite printing unit sub-assembly 3.

It is apparent from FIG. 1 that coolant is supplied to the satellite cylinder 5 for cooling purposes from the aforementioned non-illustrated cooling device by means of a forward flow line 20, and discharged therefrom by a return flow line 21. The enters an annularly cylindrical hollow chamber 22 of the satellite cylinder 5 which is situated just below the outer cylindrical surface 19, so that a good cooling effect is obtained because of the high heat-transfer coefficient.

FIG. 2 illustrates the construction of the satellite printing unit sub-assembly 2 in the vicinity of the satellite cylinder 5. The satellite cylinder 5 is journalled at both ends thereof by means of bearings 24 in a frame 23 of the printing press. Adjacent to the satellite cylinder 5, and likewise journalled in the printing-press frame 23, are the impression cylinders 10 and 11 of the printing units 6 and 7, respectively.

The satellite and impression cylinders 5, 10 and 11 are interconnected in a rotationally-locked manner through the intermediary of gearwheels 25 at the drive side of the printing-press frame 23.

The satellite cylinder 5 is provided at both ends thereof with a respective shaft stub 26; at the operator side of the press frame 23, the respective shaft stub 26 is in the form of a hollow shaft containing a central tube 27 which extends over virtually the entire length of the satellite cylinder 5. The central tube 27 is connected to the forward flow line 20 (FIG. 1), which serves to supply coolant from the non-illustrated cooling device. The coolant which is supplied escapes from the end 28 of the central tube 27 inside the satellite cylinder 5 and, accordingly, enters the hollow chamber 22. The central tube 27 is held in a mechanically rigid manner inside the satellite cylinder 5 by means of radial, bar-shaped spacers 29. The hollow chamber 22 is connected by an annularly cylindrical channel 30, which extends through the operator-side shaft stub 26, to the return line 21 (FIG. 1), so that the coolant is able to return to the non-illustrated cooling device.

In operation, the outer cylindrical surface 19 of the satellite cylinder 5 is cooled to below the dew point by the hereinafore-described coolant circuit, resulting in the formation of the aforedescribed film of moisture which prevents smearing of fresh printing ink.

According to a preferred embodiment of the invention, the outer cylindrical surface 19 of the satellite cylinder 5 is made of metal. Preferably, the outer cylindrical surface 19 of the satellite cylinder 5 is chrome-plated which ensures an optimal production of a moisture film due to the cooling to below the dew point, and prevents smearing.

Another embodiment of the invention is described hereinbelow with reference to FIG. 1. Deviating from the representation in FIG. 1, the impression cylinders 10, 11, 12 and 13 of the upper and lower satellite printing unit sub-assemblies 2 and 3 are not in engagement with the respective satellite cylinders 4 and 5, but are rather spaced a distance therefrom. However, the impression cylinders 10, 13 as well as 11, 12 are, with the web stock 14 interposed, in contact with one another. The web stock 14 comes from below and passes vertically between the two impression cylinders 11, 12. Then, the satellite cylinder 4 of the satellite printing unit sub-assembly 3 is embraced in an approximately 180-degree loop of the web stock 14. As it progresses farther, the web stock 14 passes between the two mutually engaging impression cylinders 10, 13 of the satellite printing unit sub-assembly 3. Thereafter, the web stock 14 then passes, likewise vertically, to the satellite printing unit sub-assembly 2 and between the mutually engaging impression cylinders 11, 12. Then, the web stock 14 embraces approximately 180 degrees of the satellite cylinder 5 constructed in accordance with the invention. Thereafter, the web stock 14 passes between the two mutually engaging impression cylinders 10, 13 of the satellite printing unit sub-assembly 2 and is further guided vertically upwards, where it is suitably deflected.

With the aforedescribed construction, in each satellite printing unit assembly 2, 3, two ink colors are applied to each side of the web stock 14, so that a four-color print is the overall result. It is of advantage that the satellite printing unit sub-assemblies 2 and 3 may be of basically identical construction, which may be kept relatively simple by the use of identical components. Furthermore, the web stock is guided by the shortest path through the printing-unit assembly. The satellite cylinder 4 may be provided, likewise in accordance with the invention, with a cooling device.

The foregoing is a description corresponding in substance to German Application P 42 31 263.9, dated Sept. 18, 1992, the International priority of which is being claimed for the instant application, and which is hereby made part of this application. Any material discrepancies between the foregoing specification and the aforementioned corresponding German application are to be resolved in favor of the latter.

I claim:

1. Printing-unit assembly of a web-fed printing press, the printing-unit assembly having a smear-preventing device and being assembled of at least two satellite printing unit sub-assemblies, respectively, including a satellite cylinder, one of the satellite printing unit sub-assemblies being actuatable for printing on one side of web stock, and the other of the satellite printing unit sub-assemblies being actuatable for printing thereafter on the other side of the web stock, the smear-preventing device being associated with the satellite cylinder of the other satellite printing unit assembly for preventing smearing of printing ink, the smear-preventing device comprising means for cooling an outer cylindrical surface of the satellite cylinder of the other satellite printing unit sub-assembly to a temperature below the dew point.

2. Printing-unit assembly according to claim 1, wherein said coolant means include at least one coolant channel formed in the satellite cylinder of the other satellite printing unit sub-assembly, said coolant channel being traversible by a coolant of said cooling means.

3. Printing-unit assembly according to claim 2, wherein said one coolant channel extends helically below the outer cylindrical surface of the satellite cylinder of the other satellite printing unit sub-assembly.

4. Printing-unit assembly according to claim 1, wherein the outer cylindrical surface of the satellite cylinder of the other satellite printing unit sub-assembly is made of metal.

5. Printing-unit device according to claim 4, wherein said metal is chromium plated on the outer cylindrical surface of the satellite cylinder of the other satellite printing unit sub-assembly.

* * * * *